US008439007B2

(12) United States Patent
Steiner et al.

(10) Patent No.: US 8,439,007 B2
(45) Date of Patent: May 14, 2013

(54) CYLINDER HEAD WITH OIL RETURN

(75) Inventors: Bernd Steiner, Bergisch Gladbach (DE); Kai Sebastian Kuhlbach, Bergisch Gladbach (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 357 days.

(21) Appl. No.: 12/875,550

(22) Filed: Sep. 3, 2010

(65) Prior Publication Data

US 2011/0056456 A1 Mar. 10, 2011

(30) Foreign Application Priority Data

Sep. 9, 2009 (DE) ..... 10 2009 029 289

(51) Int. Cl.
*F02F 1/24* (2006.01)
*F02F 1/42* (2006.01)

(52) U.S. Cl.
USPC ..... 123/193.5; 123/196 AB

(58) Field of Classification Search ..... 123/193.5, 123/196 AB; 184/104.2
See application file for complete search history.

(56) References Cited

U.S. PATENT DOCUMENTS 4,556,024 A * 12/1985 King et al. ..... 123/196 AB
5,551,384 A * 9/1996 Hollis ..... 123/142.5 R
7,299,782 B2 11/2007 Netsu et al.
7,992,535 B2 * 8/2011 Steiner et al. ..... 123/196 AB
2003/0098005 A1 * 5/2003 Ito et al. ..... 123/193.5
2009/0151327 A1 6/2009 Zimmermann

FOREIGN PATENT DOCUMENTS

| | | | |
|---|---|---|---|
| DE | 2252705 | A1 | 5/1974 |
| DE | 10141534 | A1 | 6/2002 |
| DE | 20311703 | U1 | 11/2003 |
| DE | 102007060397 | | 6/2009 |
| DE | 102008057338 | A1 | 6/2009 |
| EP | 1722090 | A2 | 11/2006 |
| JP | 61047437 | U | 3/1986 |
| JP | 61135911 | A | 6/1986 |
| JP | 1182560 | A | 7/1989 |
| JP | 3179122 | A | 8/1991 |
| JP | 8177440 | A | 7/1996 |
| JP | 2005226474 | A * | 8/2005 |

OTHER PUBLICATIONS

German Examination Report dated Sep. 9, 2009, pp. 1-4.
German Search Report for S.N. 10-2009-045-320.2 mailed Jan. 24, 2012.

(Continued)

*Primary Examiner* — M. McMahon
(74) *Attorney, Agent, or Firm* — Julia Voutyras; Brooks Kushman P.C.

(57) ABSTRACT

Engine oil may pool in various locations in the cylinder head near the valves and underneath the camshaft. Rather than directly conducting the oil to the oil return passages, the oil is conducted to a surface proximate the exhaust ducts before being conducted to the oil return passage so that the oil is readily warmed up during a cold start by the contact with a surface in the cylinder head proximate exhaust ducts. The provision of such a surface proximate exhaust ducts is facilitated by the integrated exhaust manifold design in which the exhaust ducts are merged prior to exiting the cylinder head. By rapidly heating the oil, the oil's viscosity decreases, thereby reducing friction and improving fuel efficiency.

13 Claims, 3 Drawing Sheets

OTHER PUBLICATIONS

German Search Report dated Jan. 24, 2012, Application No. 10 2009 045 320.2.

Kuhlbach, K., et al., "Cylinder Head with Integrated Exhaust Manifold for Downsizing Concepts", MTZ Apr. 2009 vol. 70, pp. 12-17.

Kuhlbach, K., et al., Zylinderkopf mit integriertem Abgaskrummer fur Downsizing-Konzeple, MTZ Apr. 2009 vol. 70, pp. 286-293.

EP Search Report dated Apr. 12, 2011 from EP Publication No. 10154681.

* cited by examiner

CYLINDER HEAD WITH OIL RETURN

CROSS-REFERENCE TO RELATED APPLICATIONS

This application claims foreign priority benefits under 35 U.S.C. §119(a)-(d) to DE 10 2009 029289.6 filed Sep. 9, 2009, which is hereby incorporated by reference in its entirety.

BACKGROUND

1. Technical Field

The disclosure relates to a cylinder head which can be connected at an assembly end side, or combustion chamber side, to a cylinder block, having at least two cylinders arranged along the longitudinal axis of the cylinder head, with each cylinder having at least one exhaust port for discharging the exhaust gases, which exhaust port is adjoined by an exhaust duct, and the exhaust ducts of at least two cylinders merge to form an overall exhaust duct within the cylinder head, so as to form at least one integrated exhaust manifold. At least one oil return passage is arranged on the side of the integrated exhaust manifold which faces away from the at least two cylinders, and at least one surface which is provided on that side of the cylinder head which is situated opposite the assembly end side, which surface delimits the cylinder head in the outward direction and serves for collecting engine oil and conducting said engine oil into the at least one oil return passage, with the at least one surface extending along the longitudinal axis of the cylinder head.

The disclosure also relates to the use of a cylinder head of said type for an internal combustion engine.

Within the context of the present disclosure, the expression "internal combustion engine" encompasses diesel engines, spark-ignition engines and any other suitable engines in which the combustion involves the working fluid.

2. Background Art

Internal combustion engines have a cylinder block and a cylinder head which can be or are connected to one another to form the combustion chambers. The individual components will be discussed briefly below.

To hold the pistons or the cylinder liners, the cylinder block has a corresponding number of cylinder bores. The piston of each cylinder of an internal combustion engine is guided in an axially movable manner in a cylinder liner and, together with the cylinder liner and the cylinder head, delimits the combustion chamber of a cylinder. The piston crown forms a part of the combustion chamber, and together with the piston rings, seals off the combustion chamber from the cylinder block or the crankcase to limit gases from the combustion chamber passing into the crankcase and to limit oil passing from the crankcase into the combustion chamber.

The piston serves to transmit the gas forces generated by the combustion to the crankshaft. For this purpose, the piston is articulatedly connected by a piston pin to a connecting rod, which in turn is movably mounted on the crankshaft.

The crankshaft, which is mounted in the crankcase, absorbs the connecting rod forces, which are composed of the gas forces as a result of the combustion of fuel and air in the combustion chamber and the mass forces as a result of the non-uniform movement of the engine parts. The reciprocating motion of the pistons is transformed into rotational motion of the crankshaft. The crankshaft transmits the torque to the drivetrain. A part of the energy transmitted to the crankshaft is used for driving auxiliary units such as the oil pump and the alternator, or serves for driving the camshaft for actuating the valve drive.

The crankcase is generally of modular, often two-part design. The cylinder block, which serves as the upper crankcase half, is supplemented by an oil pan which serves as a lower crankcase half. To hold the oil pan, the cylinder block has a flange surface. In general, to seal off the crankcase with respect to the environment, a seal is provided in or on the flange surface.

To hold and mount the crankshaft, at least two bearings are provided in the crankcase, which bearings are generally of two-part design and comprise in each case one bearing saddle and one bearing cover which can be connected to the bearing saddle. The crankshaft is mounted in the region of the crankshaft journals which are arranged spaced apart from one another along the crankshaft axis and are generally formed as thickened shaft extensions. Here, bearing covers and bearing saddles may be formed as separate components or in one piece with the crankcase, that is to say the crankcase halves. Bearing shells may be arranged as intermediate elements between the crankshaft and the bearings.

In the assembled state, each bearing saddle is connected to the corresponding bearing cover. In each case one bearing saddle and one bearing cover—if appropriate in interaction with bearing shells as intermediate elements—form a bore for holding a crankshaft journal. The bores are conventionally supplied with engine oil, that is to say lubricating oil, such that a load-bearing lubricating film is ideally formed between the inner surface of each bore and the associated crankshaft journal as the crankshaft rotates—similarly to a plain bearing.

To supply the bearings with oil, a pump for feeding engine oil to the at least two bearings is provided, with the pump supplying engine oil originating from the oil pan via a supply line to a main oil gallery, from which ducts lead to the at least two bearings. The supply line leads from the pump through the cylinder block to the main oil gallery. To form the so-called main oil gallery, a main supply duct is often provided which is aligned along the longitudinal axis of the crankshaft. The main supply duct may be arranged above or below the crankshaft in the crankcase or else integrated into the crankshaft.

As well as forming the combustion chambers, the cylinder head conventionally also serves to hold the valve drive. To control the exchange of gases, an internal combustion engine requires control elements and actuating devices for actuating the control elements. The valve actuating mechanism required for the movement of the valves, including the valves themselves, is referred to as the valve drive. It is the task of the valves driven by a valve drive to open and close the intake and exhaust ports of the cylinders to allow fresh air or mixture to be inducted into the combustion chambers and exhaust gases to be expelled from the combustion chambers.

One example of a valve actuating device includes inter alia at least one camshaft, on which a multiplicity of cams is arranged.

Overhead camshafts are conventionally mounted in the cylinder head, with the camshaft being held by a so-called camshaft holder which is provided on that side of the cylinder head which is situated opposite the assembly end side.

Like the crankshaft, the camshaft or the camshaft bearings is also supplied with oil. The description above with regard to the crankshaft bearing arrangement apply analogously, with the use of bearing shells as intermediate elements often being dispensed with, or with the bearings being designed, if appropriate, as rolling bearings.

To supply the camshaft holder with lubricating oil, a supply duct is provided that may branch off from the main oil gallery extending through the cylinder block and, in the case of overhead camshafts, extending into the cylinder head.

To vary the position of the camshaft in relation to the crankshaft for the purpose of adjusting the control times of the valves, use is often made of camshaft adjusters. In some engines, the position of the camshaft relative to the crankshaft is varied by a rotation of the camshaft. The variation of the control times is one measure for reducing the fuel consumption of an internal combustion engine. Camshaft adjusters are often hydraulically actuated and must likewise be supplied with engine oil.

The oil under pressure supplied to the camshaft and the variable camshaft timing (VCT) system leaks out through small orifices into the cylinder head. Once the oil is in the cylinder head, it is no longer under pressure, but pools in the cylinder head, of course, not on the side of cylinder head in which the combustion chamber is provided. Under the force of gravity, engine oil, drains through oil return passages through the cylinder head and block to the oil pan to thereby close the oil circuit of the internal combustion engine.

To collect the oil dripping from the camshaft and VCT a surface is provided on the side of the cylinder head situated opposite the combustion chamber side. The which surface delimits the cylinder head in the outward direction, that is to say concomitantly forms the surface of the cylinder head, and extends—like the camshaft and the crankshaft—along the longitudinal axis of the cylinder head. According to the prior art, said surface is an open, narrow duct, that is to say a channel.

The friction in the bearings mentioned and described above, in particular the bearings of the crankshaft and the camshaft, and also the friction in the connecting rod bearings and the piston-liner interface, depends significantly on the viscosity of the oil. When the temperature of the oil is lower, the viscosity is greater, the friction is greater, and the fuel consumption of the engine is greater. By bringing the temperature of the oil to its operating temperature from a cold start condition, improves fuel efficiency as well as reducing engine out levels of regulated emissions.

SUMMARY

In background engines, oil pools in various locations in the cylinder head near the valves and underneath the camshaft and is conducted toward oil return passages at a location proximate to the valves and the camshaft, i.e., the drain hole is conveniently located so that the oil is readily returned to the oil pan via the oil return passages. According to an embodiment of the disclosure, the cylinder head is one in which there is an integrated exhaust manifold. Rather than directly conducting the oil to the oil return passages, the oil is conducted to a surface proximate the exhaust ducts before being conducted to the oil return passage so that the oil is readily warmed up during a cold start by the contact with a surface in the cylinder head proximate exhaust ducts. The provision of such a surface proximate exhaust ducts is facilitated by the integrated exhaust manifold design.

According to one embodiment, a cylinder head has at least two cylinder tops arranged along a longitudinal axis with each cylinder top having at least one exhaust port adjoining an exhaust duct. The exhaust ducts merge to form an overall exhaust duct within the cylinder head. An area or space is provided along a side of the cylinder head away from a combustion chamber side of the cylinder head. Oil return passages are arranged proximate the space and are displaced toward short ends of the cylinder head. The space overlaps a location of merging of the exhaust ducts. The space is generally perpendicular to a direction of gravity for the cylinder head as installed with the space sloping downward generally in the direction of the oil return passages. Oil collects proximate cylinder tops and the space slopes generally downwardly from where the oil collects toward the overall exhaust duct. The space is generally trapezoidal with a length as measured perpendicular to the cylinder longitudinal axis. The width of the space is greater than half of a diameter of the exhaust port. The return oil passages are arranged on opposite sides of the overall exhaust duct. The space is generally trapezoidal with the longest dimension of the space proximate the longitudinal axis and the shortest dimension proximate the overall exhaust duct. Each cylinder top has two exhaust ports coupled to exhaust ducts that merge into combined exhaust ducts that merge into an overall exhaust duct.

A cylinder head includes cylinder tops arranged along a longitudinal axis with each cylinder top defining an exhaust port adjoining an exhaust duct, an area or space provided within the cylinder head proximate the exhaust ports, and oil return passages on either side of the space. The space is provided to conduct oil generally from proximate the cylinder tops toward the exhaust ducts and then toward the oil return passages. The space has a slight slope to cause oil to flow from the cylinder tops toward the exhaust ducts and then toward the oil return passages. The space is generally trapezoidal as viewed from a top of the cylinder head. A longest dimension of the generally trapezoidal space is nearer the longitudinal axis of the cylinder head. The space has a width, b, as measured perpendicularly with respect to a longitudinal axis of the cylinder head that is greater than half of a diameter of the exhaust port. The space is generally perpendicular to a direction of gravity when the cylinder head is installed. The cylinder tops each have two exhaust ports adjoining exhaust ducts, the exhaust ducts merge to form combined exhaust ducts, the combined exhaust ducts merge to form an overall exhaust duct, and the space is sloped to conduct oil from proximate the cylinder tops toward the exhaust ducts, toward the combined exhaust ducts, toward the overall exhaust duct, and then to the oil return passages. The cylinder head has an integrated exhaust manifold and the space slopes from the cylinder tops generally toward the integrated exhaust manifold.

A cylinder head, according to an embodiment of the disclosure has: cylinder tops arranged along a longitudinal axis, with each cylinder top having two exhaust ports adjoining an exhaust duct with pairs of exhaust ducts merging to form combined exhaust ducts and the combined exhaust ducts merging to form an overall exhaust duct within the cylinder head thereby forming an integrated exhaust manifold; a space or cavity provided on a side of the cylinder head away from a combustion chamber side of the cylinder head wherein the space overlaps the combined exhaust ducts and the space slopes downwardly from the cylinder tops to the combined exhaust ducts. The cylinder head further includes two oil return passages arranged proximate edges of the space and proximate short ends of the cylinder head. The space is generally perpendicular to a direction of gravity for the cylinder head as installed with the space sloping downward generally in the direction of the oil return passages. The space is generally trapezoidal in a direction perpendicular to gravity for the cylinder head.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

Figure 1:
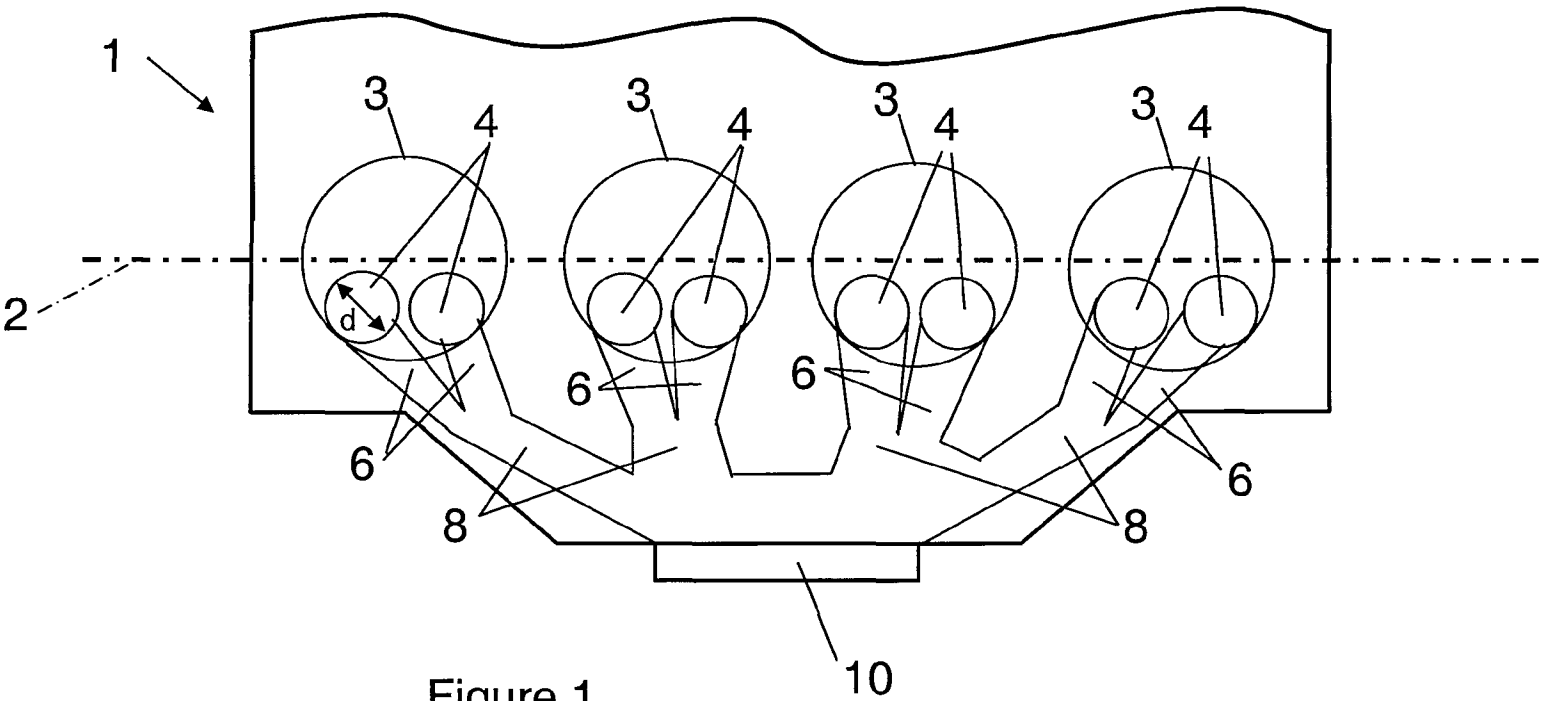
FIGS. 1 and 2 schematically show a plan view of embodiments showing a portion of a cylinder head.
Figure 2:
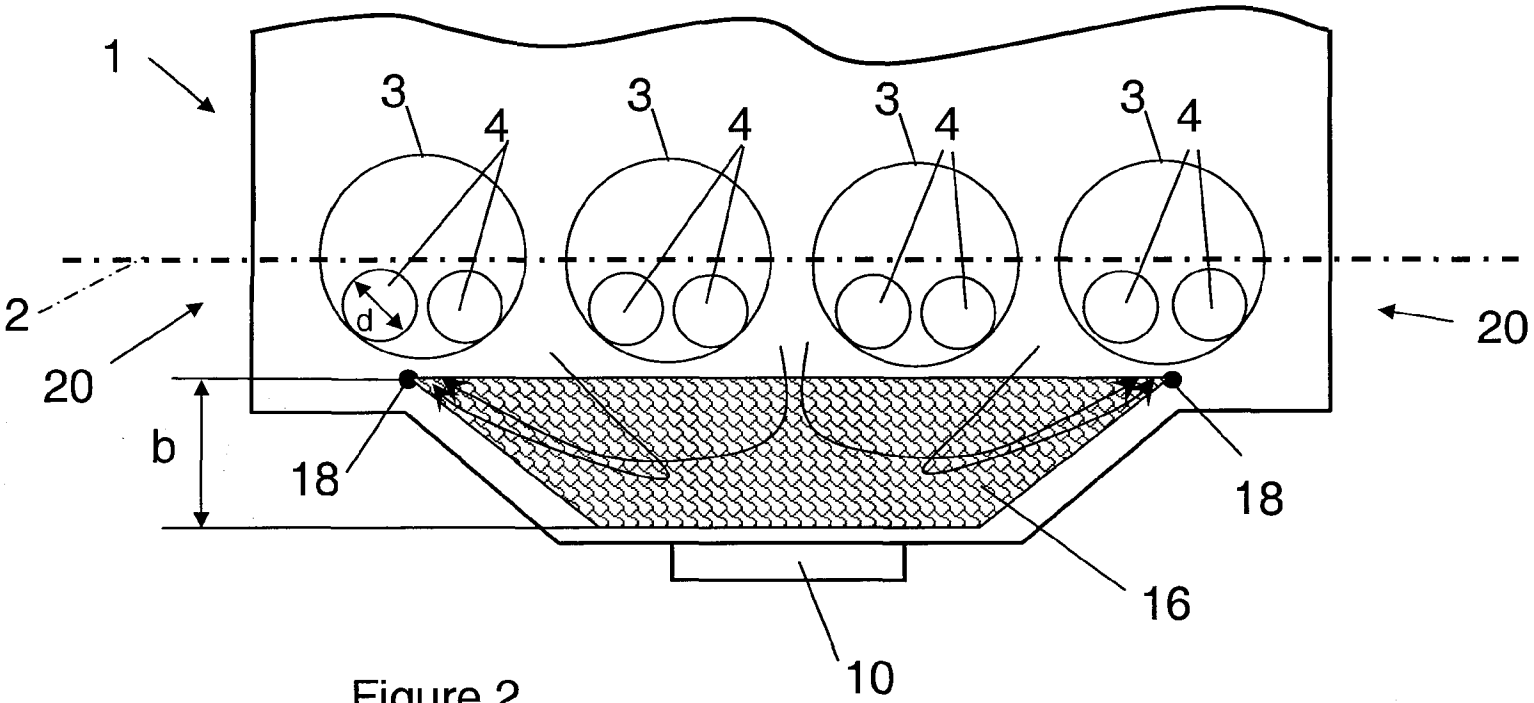
Figure 3:
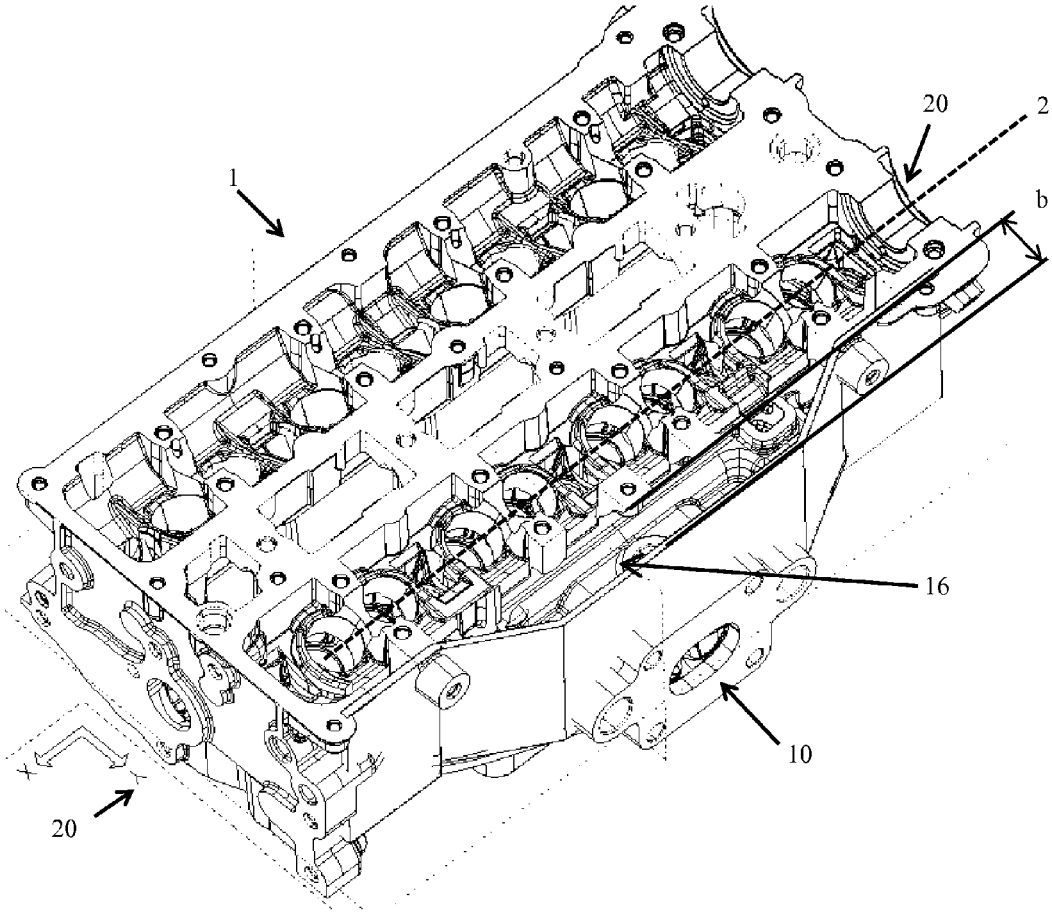
FIG. 3 shows a perspective view of an embodiment of a cylinder head according to the present disclosure.

FIG. 1 schematically shows a plan view, along longitudinal axes of the cylinders, of a portion of an embodiment of a cylinder head 1. The view in FIG. 1 is looking down from the top of an engine in which a valve train may be provided. The underside, per the view in FIG. 1, is the surface that mounts onto a cylinder block (not shown). The cylinder head surfaces mounting over cylinders in the cylinder block and the pistons (also not shown) delimit combustion chambers. Cylinder head 1 has four cylinder tops 3 arranged along a longitudinal axis 2 of cylinder head 1, with each cylinder top 3 having two exhaust ports 4, which are adjoined by exhaust ducts 6 for discharging the exhaust gases. Exhaust ducts 6 of the four cylinder tops 3 merge to form combined exhaust ducts 8 which then merge to form an overall exhaust duct 10 within cylinder head 1, so as to form an integrated exhaust manifold Referring now to FIG. 2 and FIG. 3, a space 16 is arranged in cylinder head 1 to conduct the oil that exits the camshaft, the VCT, and any other sources over space 16 and then into oil return passages 18. Arrows are shown in FIG. 2 to provide an indication of a desired oil path. Oil return passages 18 are provided proximate space 16 displaced toward short ends 20 of cylinder head 1.

In one embodiment, oil return passages 18 are outboard of a plane that runs through a longitudinal axis of an outer cylinder top 3 and is perpendicular to longitudinal axis 2 of cylinder head 1. In some embodiments, oil return passages are arranged in relation to space 16 away from overall exhaust duct 10.

Space 16 is generally perpendicular to the axis of gravity as cylinder head 1 is installed. However, space 16 is not completely perpendicular but tapers from a collection area of the oil, which is proximate cylinder tops 3, toward overall exhaust duct 10 and finally the lowest portion of space 16 is in the vicinity of oil return passages 18. Space 16 has a generally trapezoidal shape having a maximum width b near the center of cylinder head 1.

The trapezoidal shape ensures a large-area overlap with the manifold, which aids heating the oil.

While the best mode has been described in detail, those familiar with the art will recognize various alternative designs and embodiments within the scope of the following claims. Where one or more embodiments have been described as providing advantages or being preferred over other embodiments and/or over background art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. For example, it may be desirable to have an extensive set of sensors to provide an accurate assessment of the state of vehicle accessories. However, to maintain a desirable cost structure, a satisfactory estimation of some accessory quantities may be ascertained by inferring from a lesser set of sensor data. The embodiments described as being less desirable relative to other embodiments with respect to one or more characteristics are not outside the scope of the disclosure as claimed.

What is claimed:

1. A cylinder head, comprising:

at least two cylinders each having at least one exhaust port;

individual exhaust ducts coupled to each exhaust port;

a combined exhaust duct coupling all individual exhaust ducts; and an oil collection space within the cylinder head proximate to the exhaust ports, the space having a generally trapezoidal shape.

2. The cylinder head of claim 1 wherein the space is generally horizontal with a bottom surface contoured to convey oil generally in the direction of oil return passages.

3. The cylinder head of claim 1 wherein oil collects proximate the cylinders and the space slopes generally downward from where the oil collects toward the combined exhaust duct.

4. The cylinder head of claim 1 wherein the space is generally trapezoidal with a width as measured perpendicular to the cylinder head longitudinal axis; an exhaust port provided in the cylinder having a diameter; and the width of the surface is greater than half of the diameter of the exhaust port.

5. The cylinder head of claim 1 wherein the space is generally trapezoidal with the longest dimension of the space proximate the cylinders.

6. A cylinder head, comprising:

cylinders arranged along a longitudinal axis with each cylinder comprising an exhaust port adjoining an exhaust duct; and an oil cavity provided within the cylinder head proximate the exhaust ports, the cavity having a surface in thermal communication with the exhaust duct, wherein the surface is contoured to conduct oil generally from proximate the cylinders toward the exhaust ducts and then toward oil return passages on either side of the surface.

7. The cylinder head of claim 6 wherein the oil cavity is generally trapezoidal as viewed from a top of the cylinder head.

8. The cylinder head of claim 7 wherein a longest dimension of the generally trapezoidal oil cavity is nearer the cylinders.

9. The cylinder head of claim 6 wherein the oil cavity has a width as measured perpendicularly with respect to a longitudinal axis of the cylinder head that is greater than half of a diameter of the exhaust port.

10. The cylinder head of claim 6 wherein the cylinders each have two exhaust ports adjoining exhaust ducts, the exhaust ducts merge to form combined exhaust ducts, the combined exhaust ducts merge to form an overall exhaust duct, and the surface is sloped to conduct oil from proximate the cylinders toward the exhaust ducts, toward the combined exhaust ducts, toward the overall exhaust duct, and then to the oil return passages.

11. The cylinder head of claim 6 wherein the cylinder head has an integrated exhaust manifold and a bottom surface of the oil cavity slopes downward from the cylinders generally toward the integrated exhaust manifold.

12. A cylinder head, comprising:

cylinders arranged along a longitudinal axis, with each cylinder having two exhaust ports adjoining an exhaust duct with pairs of exhaust ducts merging to form combined exhaust ducts and the combined exhaust ducts merging to form an overall exhaust duct within the cylinder head thereby forming an integrated exhaust manifold; and a generally trapezoidal space provided on a side of the cylinder head away from a combustion chamber side of the cylinder head wherein the space overlaps the combined exhaust ducts and a bottom surface of the space slopes downwardly from the cylinders to the combined exhaust ducts.

13. The cylinder head of claim 12 wherein the space is generally horizontal and contoured to conduct oil generally in the direction of oil return passages arranged proximate edges of the surface.

* * * * *